US012736229B2

(12) United States Patent
Fawaz

(10) Patent No.: US 12,736,229 B2
(45) Date of Patent: Sep. 15, 2026

(54) SYSTEMS AND METHODS FOR VENTILATING FUMES

(71) Applicant: Midea Group Co., Ltd., Beijiao (CN)

(72) Inventor: Bassam Fawaz, Louisville, KY (US)

(73) Assignee: Midea Group Co., Ltd., Foshan (CN)

( * ) Notice: Subject to any disclaimer, the term of this patent is extended or adjusted under 35 U.S.C. 154(b) by 433 days.

(21) Appl. No.: 18/467,112

(22) Filed: Sep. 14, 2023

(65) Prior Publication Data

US 2025/0093049 A1 Mar. 20, 2025

(51) Int. Cl.
*F24C 15/20* (2006.01)

(52) U.S. Cl.
CPC ..... *F24C 15/2042* (2013.01)

(58) Field of Classification Search
None
See application file for complete search history.

(56) References Cited

U.S. PATENT DOCUMENTS 6,920,874 B1 * 7/2005 Siegel ..... F24C 15/2021 236/44 C
8,381,638 B1 2/2013 Rhee
9,125,245 B2 * 9/2015 Armstrong ..... H05B 6/6423
10,041,687 B1 * 8/2018 Caneba ..... F24C 15/20
2008/0053426 A1 * 3/2008 Erdmann ..... F24C 15/36 126/299 R
2008/0203095 A1 8/2008 Magno
2009/0264060 A1 * 10/2009 Livchak ..... F28C 3/06 165/104.31

FOREIGN PATENT DOCUMENTS

CN 206617995 U 11/2017
CN 112555934 A * 3/2021 ..... H04L 65/40
DE 2810318 A1 * 3/1978
IN 202111050958 A 12/2021
JP H05296511 A 11/1993

OTHER PUBLICATIONS

Microvisor: Microwave Range Hood (URL: https://microvisorhood.com/); Jul. 29, 2010 (Retrieved from Internet Wayback Machine).
Ciarra: Ciarra Hood to Go Portable Mini Desktop Range Hood (URL: https://us.ciarraappliances.com/products/ciarra-hood-to-go; Mar. 4, 2023 (Retrieved publication date from Internet Wayback Machine).

* cited by examiner

*Primary Examiner* — Ko-Wei Lin
(74) *Attorney, Agent, or Firm* — Dinsmore & Shohl LLP

(57) ABSTRACT

An under-cabinet fume ventilation system may include a secondary vent hood configured to be coupled to a surface. In various embodiments, the system may have a manifold with a first end and the second end. In some embodiments, the system may include the manifold being fluidly coupled to the secondary vent hood and being configured to be fluidly coupled to a primary vent hood at the second end and coupled to the underside of the surface.

21 Claims, 2 Drawing Sheets

SYSTEMS AND METHODS FOR VENTILATING FUMES

BACKGROUND

The present embodiments relate to systems and methods for ventilating smells or fumes, with particular embodiments shown for an under-cabinet fume ventilation system and method for venting fumes of a countertop appliance.

Typical kitchen fume ventilation systems may utilize a vent hood placed directly over a stovetop to remove steam and/or smells created while cooking. However, the vent hood typically is fixed in place and may not effectively vent fumes when a countertop cooking appliance, such as an air fryer or rice cooker, is used a distance away from the stovetop, such as being placed on a countertop away from the stovetop. Thus, there is a need for a kitchen fume ventilation system that may effectively vent cooking fumes from countertop appliances and may be conveniently configured to still allow use of the countertop. A need therefore exists in the art for an under cabinet kitchen fume ventilation system.

SUMMARY

The herein-described embodiments address these and other problems associated with the art by providing an under-surface fume ventilation system. In some embodiments, the system may include a secondary vent hood configured to be coupled to a surface. In various embodiments, the system may have a manifold with a first end and a second end. In some embodiments, the system may include the manifold being fluidly coupled to the secondary vent hood and being configured to be fluidly coupled to a primary vent hood at the second end and coupled to the underside of the surface.

In addition, in some embodiments the system may include a secondary vent hood configured to be coupled to a bottom surface of a cabinet set and configured to be placed above a countertop appliance placed upon an upper surface of a countertop. The system may have a manifold with a first end and a second end. In some embodiments, the system may include the manifold being fluidly coupled to the secondary vent hood and being configured to be fluidly coupled to a primary vent hood at the second end and coupled to the underside of the surface.

In some embodiments, a method of ventilating fumes may include ventilating fumes through a secondary vent hood, where the secondary vent hood is configured to be coupled to an underside of a surface. In various embodiments, the method may include transporting fumes from the secondary vent hood through a manifold with a blower, where the manifold is fluidly coupled to the secondary vent hood and configured to be coupled to the underside of the surface. In some embodiments, the method may include exhausting the fumes through a primary vent hood, where the primary vent hood is fluidly coupled to the manifold.

In addition, in some embodiments, the method may include ventilating fumes originating from a countertop appliance through a secondary vent hood, where the secondary vent hood is configured to be coupled to a bottom surface of a cabinet set. In various embodiments, the method may include transporting fumes from the secondary vent hood through a manifold with a blower, where the manifold is fluidly coupled to the secondary vent hood and configured to be coupled to the underside of the surface. In some embodiments, the method may include exhausting the fumes through a primary vent hood, where the primary vent hood is fluidly coupled to the manifold.

These and other advantages and features are set forth in the claims annexed hereto and forming a further part hereof. However, for a better understanding of the invention, and of the advantages and objectives attained through its use, reference should be made to the figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used in any way to the scope of the claimed subject matter.

DETAILED DESCRIPTION

Figure 1:
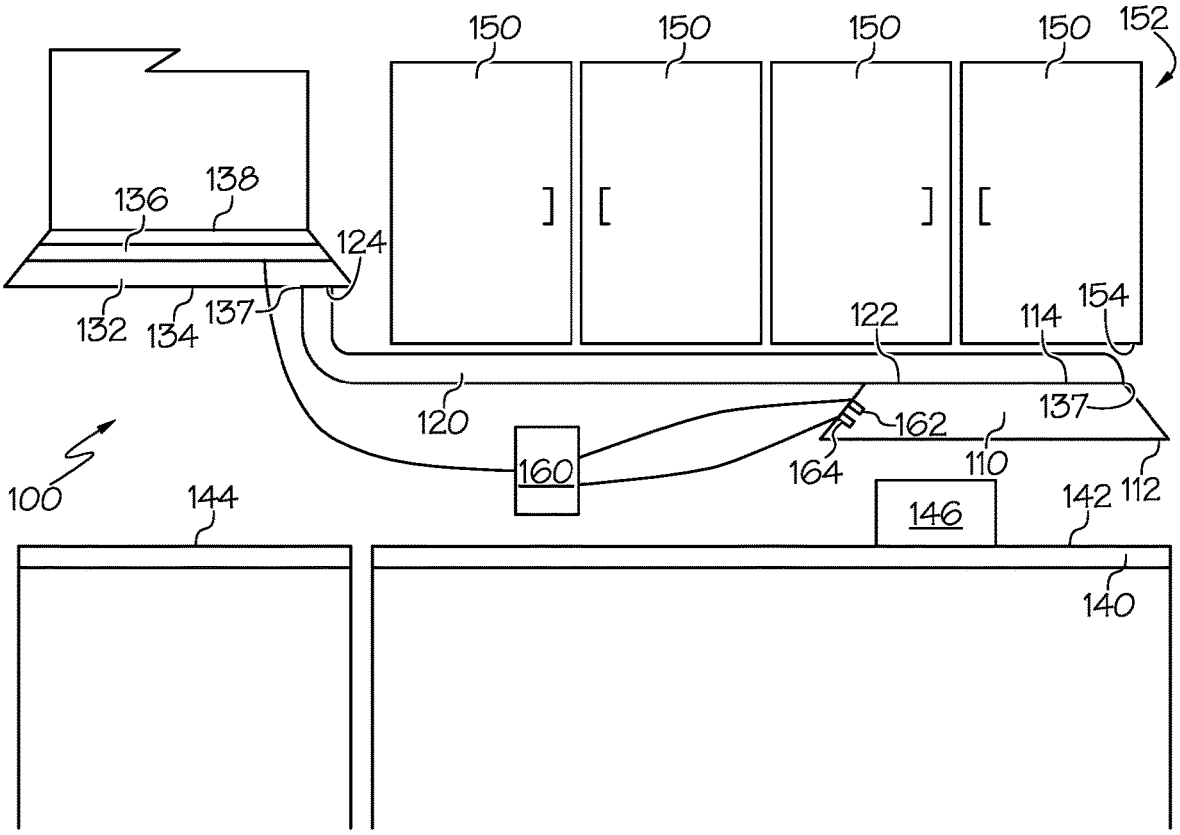
FIG. 1 is a view of a kitchen countertop, cabinet set, stovetop, primary vent hood, manifold, secondary vent hood, and controller consistent with some embodiments of the fume ventilation system.

Turning now to the drawings, wherein like numbers denote like parts throughout the several views, FIG. 1 illustrates an example fume ventilation system 100. The fume ventilation system 100 is depicted within an environment. The environment may be various environments used for food cooking or preparation, including but not limited to a residential kitchen in a house or apartment, a commercial kitchen, a restaurant, or any other suitable environment. The environment may include a countertop 140. The countertop 140 may include an upper face 142. The countertop 140 may be used as a supporting surface for various food-preparation tasks, including but not limited to use of a countertop appliance 146. The countertop appliance 146 may be any of the many common countertop appliances used in modern times, including, but not limited to, an air fryer, a rice cooker, a toaster, a toaster oven, a coffee maker, a blender, a food processor, or any other suitable type of countertop appliance 146. The countertop appliance 146 may be placed directly onto the upper face 142 of the countertop 140. During operation, fumes may originate from the countertop appliance 146, such as steam and/or smells associated with the cooking and heating of food.

The environment may include a stovetop 144. The stovetop 144 may be located along the same plane as the upper face 142 of the countertop 140. The stovetop 144 may contain one or more burners for heating and cooking food. During operation, fumes may originate from the stovetop 144, such as steam and/or smells associated with the cooking and heating of food.

The environment may include one or more cabinets 150 forming a cabinet set 152. While four cabinets 150 are shown in FIG. 1, it should be understood that in embodiments any suitable number of cabinets 150 may be used. The cabinet set 152 may have a bottom surface 154. In embodiments, the bottom surface 154 of the cabinet set 152 may be faced towards the upper face 142 of the countertop 140.

In other embodiments not illustrated, the environment may include various other structures placed above the countertop 140 and facing towards the upper face 142 of the countertop 140. As a non-limiting example, there may be shelves, storage racks, elevated appliances such as a microwave, or any other suitable structure placed above the countertop 140 and facing towards the upper face 142 of the countertop 140.

In one embodiment, the fume ventilation system 100 may be configured to be used with a primary vent hood 132. The primary vent hood 132 may be arranged above the stovetop 144. The primary vent hood 132 may have an inlet 134 and an outlet 138. The outlet 138 may be vented to an ambient opening, a further ventilation system, a collection container, or any other suitable system for ventilating fumes. In other embodiments, the primary vent hood 132 may be integrated into an appliance, such as a microwave, which may be mounted above the stovetop 144.

A blower 136 may be arranged within the primary vent hood 132. In embodiments, the blower 136 may be an electric motor and fan blade assembly for the movement of fumes. In other embodiments, the blower 136 may be a turbine style blower. Any other suitable style of blower may also be used. In some embodiments, the blower 136 may be a multi-speed blower, such that the blower 136 is capable of rotating at at least two different rotational speeds.

The fume ventilation system 100 includes a manifold 120. The manifold 120 is configured to allow for the passage of fumes therethrough. The manifold 120 may be constructed of any suitable materials, including but not limited to steel, aluminum, or plastic. The manifold 120 may have any suitable cross-sectional shape, including but not limited to a circle, an oval, a rectangle, or any other suitable shape. The manifold 120 may have a flexible construction, such that the manifold 120 may be bent around corners and reconfigured by a user. In other embodiments, the manifold 120 may be of rigid or semi-rigid construction such that the manifold 120 is pre-formed to fit a particular shape. The manifold 120 may have a first end 122 and a second end 124. In some embodiments, the manifold 120 may be configured to expand or contract in length between the first end 122 and the second end 124, such as with an accordion-style configuration. This is one way of providing expansion or customization to the desired length of the overall system.

The manifold 120 may be coupled to the bottom surface 154 of the cabinet set 152. The manifold 120 may be coupled to the bottom surface 154 of the cabinet set 152 via any suitable coupling mechanisms, including but not limited to straps, hooks, mechanical fasteners, adhesives, Velcro, or any other suitable coupling mechanisms. By mounting the manifold 120 to the bottom surface 154 of the cabinet set 152, the manifold 120 may not obstruct use of the countertop 140 for food preparation and various other tasks. However, it should be understood that in other embodiments the manifold 120 may be coupled to other suitable surfaces, such as a backsplash or wall perpendicular to the upper face 142 of the countertop 140, or directly to the upper face 142 of the countertop 140.

The second end 124 of the manifold 120 may be coupled to the primary vent hood 132. The manifold 120 may be coupled to the primary vent hood 132 with a coupler 137. The coupler 137 may be any suitable coupling mechanism, including but not limited to a worm clamp, a crimp connector, or a quick-connect coupler, such as a spring-loaded constant tension coupler. In embodiments, where the coupler 137 is a quick-connect coupler, the manifold 120 may be easily detachable from the primary vent hood 132 such as for servicing or cleaning.

The fume ventilation system 100 includes a secondary vent hood 110. The secondary vent hood 110 may be shaped and sized so as to allow for the extraction and ventilation of fumes at desired locations. In embodiments, the secondary vent hood 110 may have a conical or funnel-shape, although it is envisioned that any other suitable shape may be used. The secondary vent hood 110 may include an inlet 112 and an outlet 114. The inlet 112 may be faced towards the upper face 142 of the countertop 140, so as to allow fumes from the countertop appliance 146 or any other fume source to be vented into the secondary vent hood 110.

The outlet 114 of the secondary vent hood 110 is fluidly coupled to the first end 122 of the manifold 120. The manifold 120 may be coupled to the secondary vent hood 110 with a coupler 137. The coupler 137 may be the same type of coupler 137 used to couple the manifold 120 to the primary vent hood 132. In other embodiments, a different type of coupler 137 may be used to couple the manifold 120 to the primary vent hood 132 than is used to couple the manifold 120 to the secondary vent hood 110. In embodiments where the coupler 137 is a quick-connect coupler, the manifold 120 may be easily detachable from the primary vent hood 132 such as for servicing or cleaning.

In embodiments, the secondary vent hood 110 may be moveable along the bottom surface 154 of the cabinet set 152, such as along rails or tracks. In further embodiments, the secondary vent hood 110 may be removably coupled to the bottom surface 154 of the cabinet set 152. This may allow a user to selectably position the secondary vent hood 110 directly over the countertop appliance 146 or at other desired locations. In embodiments with a manifold 120 made of a flexible construction, the manifold 120 may flex, expand, or contract while the secondary vent hood 110 is positioned by the user.

A temperature sensor 162 may be disposed within the secondary vent hood 110. The temperature sensor 162 may be arranged so as to monitor the temperature of the air within the secondary vent hood 110. The temperature sensor 162 may be any suitable sensor for monitoring temperature of the air, including but not limited to a thermocouple, a thermistor, a resistance temperature detector, or any other suitable type of temperature sensor 162. In other embodiments, the temperature sensor 162 may be disposed in other elements of the fume ventilation system 100, such as within the manifold 120 or within the primary vent hood 132.

A humidity sensor 164 may be disposed within the secondary vent hood 110. The humidity sensor 164 may be arranged so as to monitor the humidity of the air within the secondary vent hood 110. The humidity sensor 164 may be any suitable sensor for monitoring humidity of the air, including but not limited to a capacitive humidity sensor, a resistive humidity sensor, a thermal conductivity humidity sensor, or any other suitable type of humidity sensor 164. In other embodiments, the humidity sensor 164 may be disposed in other elements of the fume ventilation system 100, such as within the manifold 120 or within the primary vent hood 132.

The fume ventilation system 100 may have a controller 160. The controller 160 may include a processor and a non-transitory, processor-readable storage medium for storing program modules that, when executed by a processor, perform one or more processes described herein. The non-transitory, processor-readable storage medium may be one or more memory devices that store data as well as software and may also comprise, for example, one or more of RAM, ROM, magnetic storage, or optical storage. The controller 160 may be communicatively coupled to the temperature sensor 162, the humidity sensor 164, and the blower 136.

While the controller 160 is illustrated as having a wired connection to the temperature sensor 162, the humidity sensor 164, and the blower 136, it should be understood that any or all of the temperature sensor 162, the humidity sensor 164, and/or the blower 136 may be communicatively coupled to the controller 160 via a network. The network may be a shared, public, or private network, may encompass a wide area or local area, and may be implemented through any suitable combination of wired and/or wireless communication networks. Furthermore, the network may include a local area network (LAN), a wide area network (WAN), an intranet, or the Internet. The network may allow for near-real time communication between devices connected over the network. Since disclosed embodiments may be implemented using an HTTPS (hypertext transfer protocol secure) environment, data transfer over a network, such as the Internet, may be done in a secure fashion.

In embodiments, the temperature sensor 162 and/or the humidity sensor 164 may send a signal to the controller 160 corresponding to the sensed temperature and/or humidity. If the sensed temperature and/or humidity exceeds a predetermined threshold, the controller 160 may send a signal to the blower 136 to activate the blower 136. If the sensed temperature and/or humidity falls below a predetermined threshold, the controller 160 may send a signal to the blower 136 to deactivate the blower 136.

In some embodiments, the controller 160 may change the speed of the blower 136, such as speeding up from a lower speed to a higher speed or slowing down from a higher speed to a lower speed in response to the sensed temperature and/or humidity crossing a predetermined threshold.

In some embodiments, the temperature and/or humidity threshold may be specified by a user, such as through a user interface communicatively coupled to the controller 160. The user interface may be a key pad, a touchscreen, a group of buttons, or any other suitable interface for the user to specify temperature and/or humidity thresholds.

In further embodiments, the blower 136 may be manually started, stopped, and/or toggled between multiple speeds with a switch, button, or other suitable manual control system. In yet further embodiments, the blower 136 may be configured to operate on a timer, such that a user may set a desired length of time for the blower 136 to operate. In other embodiments, the blower 136 may be configured to continuously operate.

Figure 2:
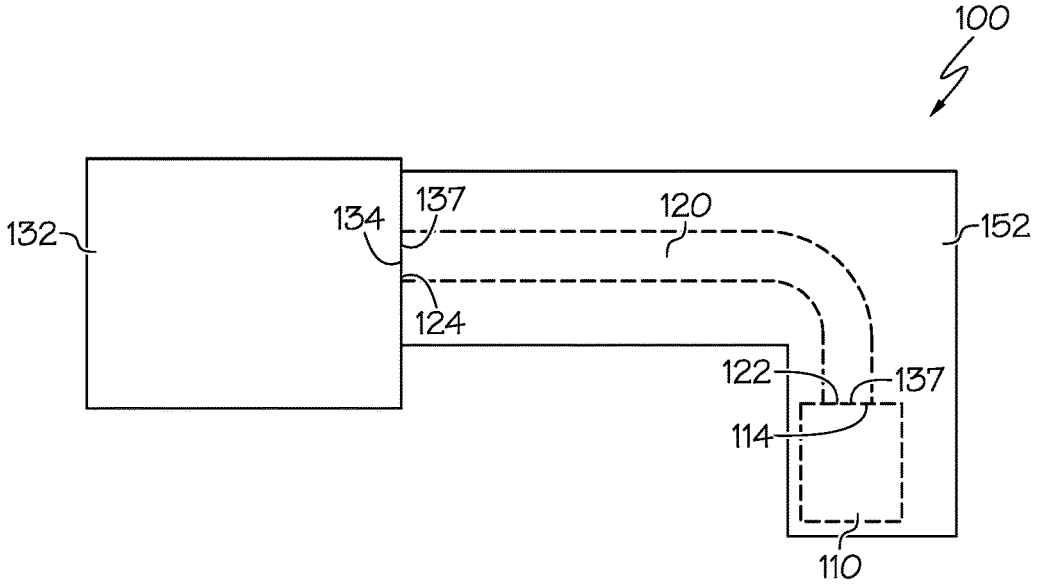
FIG. 2 is top view of the fume ventilation system illustrated in FIG. 1.

Referring now to FIG. 2, an embodiment of a top view of the fume ventilation system 100 is shown. The manifold 120 and secondary vent hood 110 are shown in phantom coupled to the bottom surface 154 of the cabinet set 152. The cabinet set 152 may be shaped as an "L" as is illustrated, such as when the cabinet set 152 is in the corner of a room. The countertop 140 may follow a similar shape as the cabinet set 152. The manifold 120 may also be arranged in an "L" shape to follow the shape of the cabinet set 152, such that the manifold 120 is coupled to the bottom surface 154 of the cabinet set 152 along the "L" shape. By following the shape of the cabinet set 152, the manifold 120 may remain in a less obtrusive position compared to a manifold 120 that goes directly from the secondary vent hood 110 to the primary vent hood 132. However, it should be understood that in some embodiments the manifold 120 may travel in a straight line between the secondary vent hood 110 and the primary vent hood 132, such that only a portion of the manifold 120 is coupled to the bottom surface 154 of the cabinet set 152.

In other embodiments, the cabinet set 152, countertop 140, and manifold 120 may be arranged in any other suitable shape, including but not limited to a straight line, a "U" shape, or any other suitable shape.

Figure 3:
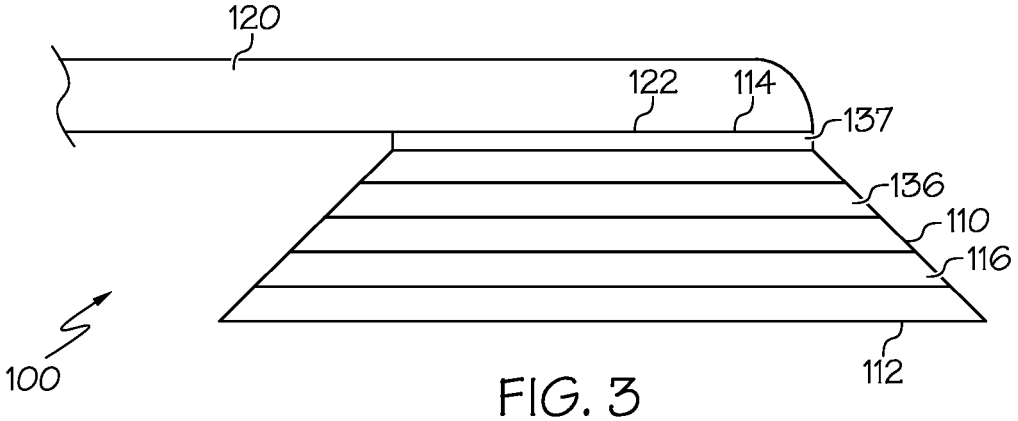
FIG. 3 is a view of an embodiment of the fume ventilation system with a filter and a blower configured inside of the secondary vent hood.

Referring now to FIG. 3, an embodiment of the secondary vent hood 110 is illustrated. The blower 136 may be disposed inside of the secondary vent hood 110. In some embodiments, the fume ventilation system 100 may have a single blower 136 such that when the blower 136 is disposed inside of the secondary vent hood 110 there is no blower 136 inside of the primary vent hood 132. In other embodiments, the fume ventilation system 100 may have a plurality of blowers 136, such that at least one blower 136 is disposed inside of the primary vent hood 132 and at least one blower 136 is disposed inside of the secondary vent hood 110. In further embodiments, as described in FIG. 1, the fume ventilation system 100 may have a blower 136 disposed inside of the primary vent hood 132 and no blower disposed in the secondary vent hood 110. When a plurality of blowers 136 are used, each of the plurality of blowers 136 may be of the same type or of different types. As a non-limiting example, the blower 136 disposed in the primary vent hood 132 may be fan blade style blower and the blower 136 disposed in the secondary vent hood 110 may be turbine style blower.

A filter 116 may be disposed inside of the secondary vent hood 110. The filter 116 may be a filter for the collection of grease, debris, and/or any other contaminants in the fumes. The filter 116 may be any suitable type of filter for use in a vent hood, including but not limited to a metal mesh filter, a charcoal filter, a paper filter, or any other suitable type of filter 116. As illustrated, the filter 116 may be arranged closer to the inlet 112 of the secondary vent hood 110 than the blower 136, such that fumes may be filtered by the filter 116 before being moved farther along the fume ventilation system 100 by the blower 136. However, it should be understood that in other embodiments the filter 116 may be arranged farther from the inlet 112 of the secondary vent hood 110 than the blower 136, such that fumes may be blown by the blower 136 through the filter 116. In further embodiments, the filter 116 may be arranged in other elements of the fume ventilation system 100, such as within the manifold 120 or within the primary vent hood 132. In yet further embodiments, a plurality of filters 116 may be arranged within the fume ventilation system 100.

Figure 4:
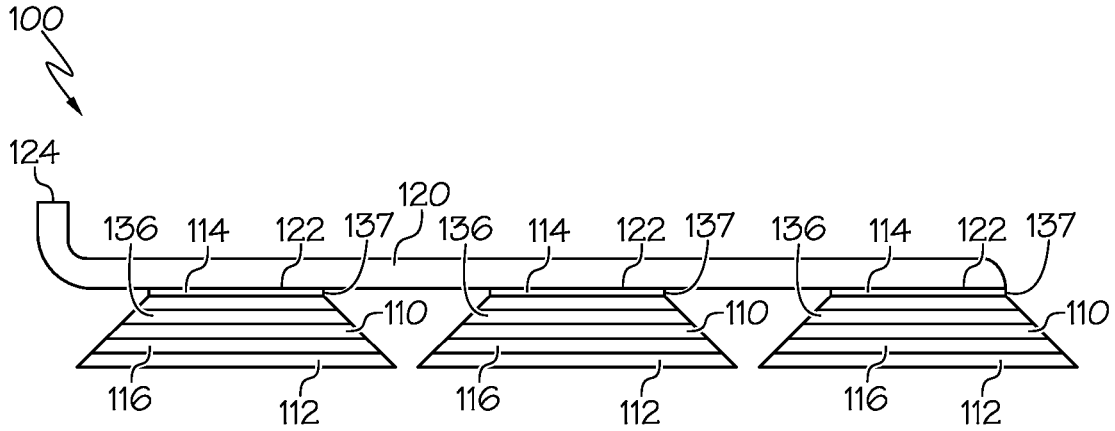
FIG. 4 is a view of an embodiment of the fume ventilation system with a plurality of secondary vent hoods.

Referring now to FIG. 4, an embodiment of a plurality of secondary vent hoods 110 fluidly coupled to the manifold 120 is shown. Each of the plurality of secondary vent hoods 110 may have a filter 116 and a blower 136 disposed therein. Each of the plurality of secondary vent hoods 110 may be arranged above an individual countertop appliance 146 on the upper face 142 of the countertop 140. In embodiments, each of the plurality of secondary vent hoods 110 may be a fixed distance apart from one another. In further embodiments, such as embodiments with an accordion-style manifold 120, the distance between each of the plurality of secondary vent hoods 110 may be adjustable, in order to position each of the plurality of secondary vent hoods 110 according to the user's needs. While three secondary vent hoods 110 are illustrated, it should be understood that in embodiments, any suitable number of secondary vent hoods 110 may be used, including but not limited to two to ten secondary vent hoods 110, or any other suitable number of secondary vent hoods 110.

Numerous variations and modifications to the fume ventilation system 100 illustrated in FIGS. 1-4 will be apparent to one of ordinary skill in the art, as apparent from the description above. Therefore, the invention is not limited to the specific implementations discussed herein.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A system for ventilating fumes, the system comprising:

a secondary vent hood, the secondary vent hood configured to be coupled to a surface; and a manifold, the manifold having a first end and a second end, wherein:

the manifold is fluidly coupled to the secondary vent hood at the first end and configured to be fluidly coupled to a primary vent hood at the second end, fluidly coupling the second end of the manifold to the primary vent hood establishing a flow path for fumes to travel into the primary vent hood from the secondary vent hood, the manifold configured to be coupled to the surface.

2. The system for ventilating fumes of claim 1, further comprising a blower, the blower being located inside of the secondary vent hood.

3. The system for ventilating fumes of claim 1, further comprising:

a plurality of secondary vent hoods, each of the plurality of secondary vent hoods configured to be coupled to the surface and fluidly coupled to the manifold.

4. The system for ventilating fumes of claim 3, further comprising a plurality of blowers, wherein each of the plurality of secondary vent hoods has at least one of the plurality of blowers disposed therein.

5. The system for ventilating fumes of claim 1, further comprising a filter, the filter being disposed inside of the secondary vent hood.

6. The system for ventilating fumes of claim 1, wherein the manifold comprises a flexible construction.

7. The system for ventilating fumes of claim 1, wherein the manifold is fluidly coupled to the secondary vent hood with a quick-connect coupler.

8. The system for ventilating fumes of claim 1, wherein the system is configured to be placed above a kitchen countertop.

9. The system for ventilating fumes of claim 8, wherein the secondary vent hood is configured to be placed above a countertop appliance.

10. The system for ventilating fumes of claim 1, further comprising:

a blower;

a temperature sensor, the temperature sensor coupled to the secondary vent hood; and a controller, the controller communicatively coupled to the temperature sensor and the blower, the controller configured to automatically activate the blower based upon an output signal generated by the temperature sensor.

11. The system for ventilating fumes of claim 1, further comprising:

a blower;

a humidity sensor, the humidity sensor coupled to the secondary vent hood; and a controller, the controller communicatively coupled to the humidity sensor and the blower, the controller configured to automatically activate the blower based upon an output signal generated by the humidity sensor.

12. The system for ventilating fumes of claim 1, wherein the surface is an underside of a cabinet set.

13. The system for ventilating fumes of claim 1, further comprising a blower disposed within the primary vent hood.

14. A method for ventilating fumes, the method comprising:

receiving fumes into a secondary vent hood, the secondary vent hood configured to be coupled to an underside of a surface;

transporting fumes from the secondary vent hood through a manifold with a blower, the manifold fluidly coupled to the secondary vent hood and the manifold configured to be coupled to the underside of the surface; and exhausting fumes through a primary vent hood, the primary vent hood fluidly being coupled to the manifold so as to establish a flow path for fumes to travel into the primary vent hood from the secondary vent hood.

15. The method for ventilating fumes of claim 14, wherein the step of ventilating fumes through the secondary vent hood further comprises ventilating fumes through a plurality of secondary vent hoods, each of the plurality of secondary vent hoods fluidly coupled to the manifold.

16. The method for ventilating fumes of claim 14, further comprising:

monitoring the temperature of the fumes with a temperature sensor, the temperature sensor configured inside of the secondary vent hood; and automatically activating the blower in response to the temperature exceeding a predetermined threshold.

17. The method for ventilating fumes of claim 14, further comprising:

monitoring the humidity of the fumes with a humidity sensor, the humidity sensor configured inside of the secondary vent hood; and automatically activating the blower in response to the humidity exceeding a predetermined threshold.

18. The method for ventilating fumes of claim 14, further comprising filtering the fumes with a filter, wherein the filter is arranged in the secondary vent hood.

19. The method for ventilating fumes of claim 14, wherein the secondary vent hood is configured to be placed above a countertop appliance and the fumes originate from the countertop appliance.

20. The method for ventilating fumes of claim 14, wherein the primary vent hood is configured to be placed above a stovetop.

21. A system for ventilating fumes, the system comprising:

a primary vent hood;

a secondary vent hood; and a manifold having a first end fluidly coupled to the primary vent hood and a second end fluidly coupled to the secondary vent hood so as to establish a flow path for fumes to travel into the primary vent hood from the secondary vent hood.

* * * * *